US009511268B1

(12) United States Patent
Levy

(10) Patent No.: US 9,511,268 B1
(45) Date of Patent: Dec. 6, 2016

(54) STICK ASSEMBLY

(71) Applicant: Michael Levy, Thornhill (CA)

(72) Inventor: Michael Levy, Thornhill (CA)

( * ) Notice: Subject to any disclaimer, the term of this patent is extended or adjusted under 35 U.S.C. 154(b) by 0 days.

(21) Appl. No.: 14/728,387

(22) Filed: Jun. 2, 2015

(51) Int. Cl.
*A63B 59/70* (2015.01)
*A63B 59/14* (2006.01)

(52) U.S. Cl.
CPC ..... *A63B 59/14* (2013.01); *A63B 59/70* (2015.10); *A63B 60/24* (2015.10); *A63B 2102/24* (2015.10)

(58) Field of Classification Search
CPC ..... A63B 60/54; A63B 60/24; A63B 59/70; A63B 2102/22–2102/24
USPC ..... 473/519, 520, 560–563
See application file for complete search history.

(56) References Cited

U.S. PATENT DOCUMENTS 2,040,132 A * 5/1936 Hall ..... A63B 59/70 473/560
3,834,697 A 9/1974 McNamara, Jr. et al.
4,364,560 A 12/1982 Gemmel
5,183,264 A * 2/1993 Lanctot ..... A63B 59/70 473/318
5,362,046 A * 11/1994 Sims ..... A63B 60/54 473/300
5,520,386 A 5/1996 Sasko
5,609,336 A * 3/1997 Tashjian ..... A63B 59/70 473/296
5,655,980 A * 8/1997 Nashif ..... A63B 60/54 473/520
6,033,327 A 3/2000 Bird
6,033,328 A * 3/2000 Bellefleur ..... A63B 59/70 473/560
6,042,485 A * 3/2000 Cheng ..... A63B 60/10 473/318
6,077,178 A * 6/2000 Brandt ..... A63B 59/50 473/520
6,113,508 A * 9/2000 Locarno ..... A63B 59/00 473/318
6,328,666 B1 12/2001 Manory
6,692,386 B2 2/2004 Brundage
6,939,273 B2 9/2005 Zajac et al.
6,955,619 B1 10/2005 Schutz et al.
7,070,524 B1 * 7/2006 Garvey, III ..... A63B 23/03516 473/519
7,108,619 B2 * 9/2006 Kavanaugh ..... A63B 60/08 473/560
7,128,669 B2 * 10/2006 Blotteaux ..... B29C 70/086 473/561
7,399,236 B2 * 7/2008 Takeuchi ..... A63B 53/14 473/300
9,050,511 B2 * 6/2015 Hicks ..... A63B 59/0092
2002/0037780 A1 * 3/2002 York ..... A63B 59/70 473/560
2003/0216197 A1 * 11/2003 LeMire ..... A63B 59/70 473/562
2006/0247077 A1 * 11/2006 Deetz ..... A63B 60/08 473/513
2008/0127721 A1 * 6/2008 Shields ..... G01M 1/365 73/65.03
2008/0312012 A1 * 12/2008 Lussier ..... A63B 59/70 473/560
2012/0046136 A1 * 2/2012 Allen ..... B29C 70/865 473/563

* cited by examiner

*Primary Examiner* — Mark Graham
(74) *Attorney, Agent, or Firm* — Bereskin & Parr LLP/S.E.N.C.R.L., s.r.l.; Kenneth L. Bousfield

(57) ABSTRACT

A hockey stick assembly has an elongate rubbery damping material installed within a hollow stick shaft. The insert may be formed with one end that has, or may have a cap or socket mounted at one end that has, an indexing member for locating the elongate material within the hollow shaft. The cap or socket or end may include a widened portion, and may include projections or a peripherally extending flange for engaging the butt end. A cap may be placed over the end of the stick once the insert has been installed. The insert may be removable. It may be a high density rubber or rubber-like polymer that may tend not to rattle. The insert may have constant thickness, and be formed to define a plug and stopper at one end. The other end is trimmed to length and slid into a loose fit within the shaft.

20 Claims, 3 Drawing Sheets

STICK ASSEMBLY

FIELD OF THE INVENTION

This invention relates to the field of sporting equipment stick assemblies.

BACKGROUND

In recent times hockey and other playing sticks have become available with hollow shafted handles. The use of the internal space in the handle may permit distributed weighting to be employed as a training feature. Although the use of weights on hockey sticks is known, it may be desirable for the weighting to be internal, such that the external space envelope of the stick is unchanged, and therefore does not affect the ability to play with the stick. It is also desirable that the weighting be simple. It may not be desirable to have complicated assemblies of multiple weights and fasteners. It may be desirable that the weighting be removable. It may be desirable that the weighting not rattle within the stick. It may be desirable that the weighting be damped, or soft.

Earlier known patents include: U.S. Pat. No. 3,834,697 of McNamera et al., issued Sep. 10, 1974; U.S. Pat. No. 4,364,560 of Gemmel, issued Dec. 21, 1982; U.S. Pat. No. 5,183,264 of Lanctot; U.S. Pat. No. 5,520,386 of Sasko, issued May 28, 1996; U.S. Pat. No. 6,033,327 of Bird, issued Mar. 7, 2000; U.S. Pat. No. 6,328,666 of Manory issued Dec. 11, 2001; U.S. Pat. No. 6,692,386 of Brundage, issued Feb. 17, 2004; U.S. Pat. No. 6,939,273 of Zajac et al. issued Sep. 6, 2005; U.S. Pat. No. 6,955,619 of Schutz et al., issued Oct. 18, 2005; and U.S. Pat. No. 7,070,524 of Garvey, issued Jul. 4, 2006;

SUMMARY OF THE INVENTION

In an aspect of the invention there is a rubbery or rubber like strip that is installed within a hollow hockey stick shaft.

In another aspect of the invention there is an insert for a hollow hockey stick shaft. It has an elongate member having a first end and a second end. The first end has an indexing member too large to pass into the hockey stick shaft. The indexing member defines an engagement interface limiting translational motion of the insert into the hollow hockey stick shaft. The elongate member includes a damping material.

In a feature of that aspect of the invention, the insert includes an enlarged end portion adjacent to the indexing member, the enlarged portion having a size that is one of: (a) an interference fit within the hollow hockey stick shaft; and (b) a clearance fit having a tolerance of lateral motion of less than the hollow hockey stick shaft's wall thickness.

In another feature, the damping material of the elongate member is at least predominantly one of: (a) a rubber material; and (b) a visco-elastic polymer. In another feature, the insert includes an end socket. The first end of the elongate member is secured within the socket; and the indexing member protrudes away from the socket substantially cross-wise to the elongate member. In a further feature, the elongate member is made from a strip of material of constant thickness. The material is a rubber-containing material. The elongate member has a predominant portion extending away from the indexing member, the predominant portion being sized to fit loosely within the hollow hockey stick shaft.

In another aspect of the invention, there is an insert for a hollow hockey stick shaft. The insert has an elongate portion that is sized to have a loose fit within the hockey stick shaft, and the elongate portion has a length to extend along at least a substantial portion of the hockey stick shaft. An indexing member is located at one end of the insert, the indexing member being too large to enter the hockey stick shaft. The elongate portion is made of a material that is one of: a rubber material; and a visco-elastic material.

In a feature of that aspect of the invention, the elongate member is made of a rubber-based material of constant thickness. The indexing member is one of (a) made monolithically as a portion of the elongate member having at least one protrusion for engaging an end of the hollow hockey stick shaft, and including a widened portion adjacent to the at least one protrusion, the widened portion at least locally inhibiting cross-wise motion of the insert within the hollow hockey stick member; and (b) a member defining a socket into which an end of the elongate member is secured, and including at least one projection for engaging an end of the hollow hockey stick shaft, the socket defining a widened portion of the insert, the widened portion at least locally inhibiting cross-wise motion of the insert within the hollow hockey stick member.

In another aspect of the invention there is a hockey stick assembly. It has a hollow shaft having a first end and a second end and a blade secured to the second end of the shaft. A weight distributing member is disposed within the shaft, that member being formed of a rubbery material.

In a feature of that aspect, the material is a visco-elastic polymer. In another feature, the weight distributing member has a substantially even weight distribution therealong. In still another feature, the member is monolithic. In a further feature, the member has a substantially uniform solid cross section running along at least a predominant portion of its length. In still another feature, the hollow hockey stick shaft has an internal cross-sectional area, and the member extends substantially from end to end of the hollow hockey stick shaft, is made of a rubbery material, and has a cross-sectional area occupying at least half of the internal cross-sectional area of the hollow hockey stick shaft.

In still another feature, the member includes an elongate body extending within the shaft and has an end portion extending out from the first end of the shaft, the end portion having laterally opposed flange portions resting on opposed edges of the first end of the shaft to prevent the end portion from sliding into the shaft. In another feature, the elongate body includes a plug portion adjacent the end portion of the member, the plug portion abutting opposed interior surfaces of the shaft to inhibit lateral movement of the end portion relative to the shaft.

In another aspect there is a hockey stick assembly. It has a hollow shaft having a first end, a second end, and an interior passage extending therebetween. A hockey stick blade is secured to the second end of the shaft. A monolithic weight distributing member extends along a length of the interior passage. The member occupies at least half a passage volume of the interior passage taken along the length of the interior passage.

In still another aspect, there is a weight distributing member for a hockey stick having a hollow shaft. The member has an elongate body dimensioned to slide in a loose fit into the hollow shaft from the butt end of the hockey stick. The elongate body is formed of a vibration damping material. The weight distributing member includes an end fitting for engaging the butt end of the hockey stick.

BRIEF DESCRIPTION OF THE FIGURES

The description is accompanied by a set of illustrative Figures in which.

DETAILED DESCRIPTION

Figure 1B:
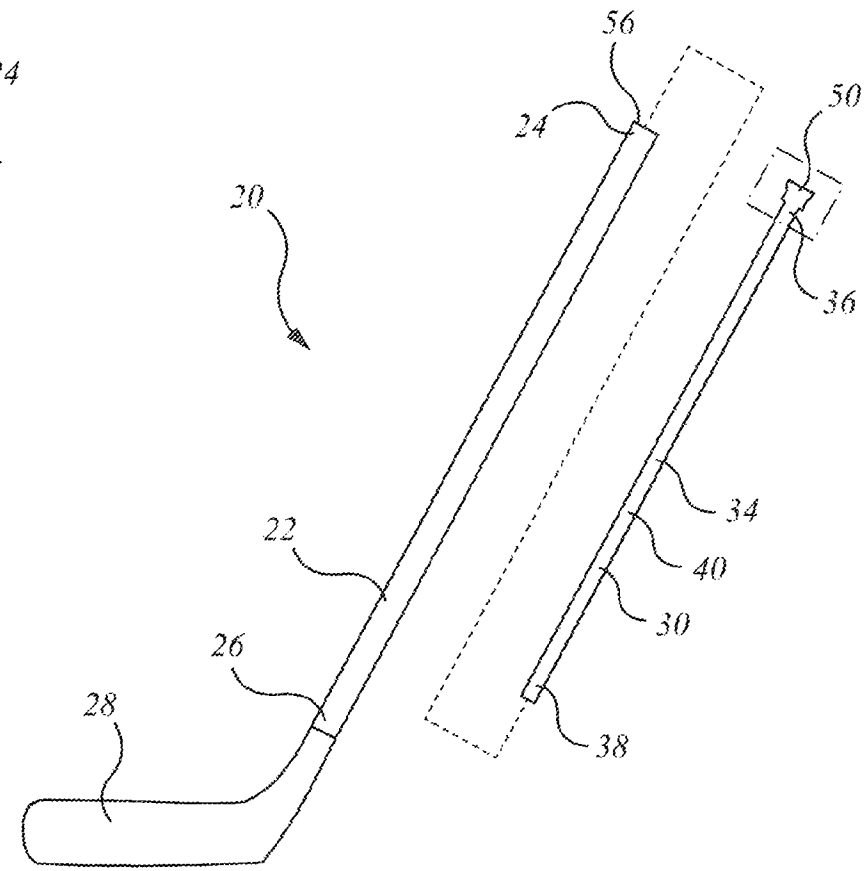
FIG. 1*b* shows an exploded side view of a hockey stick assembly of FIG. 1*a;*

The description that follows, and the embodiments described therein, are provided by way of illustration of an example, or examples, of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings may be taken as being to scale unless noted otherwise. The commonly used engineering terms "proud", "flush" and "shy" may be used herein to denote items that, respectively, protrude beyond an adjacent element, are level with an adjacent element, or do not extend as far as an adjacent element, the terms corresponding conceptually to the conditions of "greater than", "equal to" and "less than".

The terminology used in this specification is thought to be consistent with the customary and ordinary meanings of those terms as they would be understood by a person of ordinary skill and knowledge pertaining to hockey equipment in North America. The Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record, (for example, earlier publications by persons not employed by the USPTO or any other Patent Office), demonstrating how the terms are used and understood by persons of ordinary skill in the art, or by way of expert evidence of a person or persons of at least 10 years' experience in the hockey equipment.

This description pertains to hockey sticks, and hockey stick shaft members. In that regard, it may be helpful to define a frame of reference or a co-ordinate system. The longitudinal or x-direction, or x-axis may be parallel to the long axis of the stick, and may be taken as running along the centerline of the shaft. The y-direction may be taken as the cross-wise direction of the stick, being the larger dimension of the shaft and, generally, the direction in which the blade extends. The z-direction is the through-thickness direction of the shaft, the through thickness being generally smaller than the y-direction dimension. The z-direction is generally transverse to the blade. Downward may generally be taken as meaning away from the butt of the stick and toward the blade.

Figure 1A:
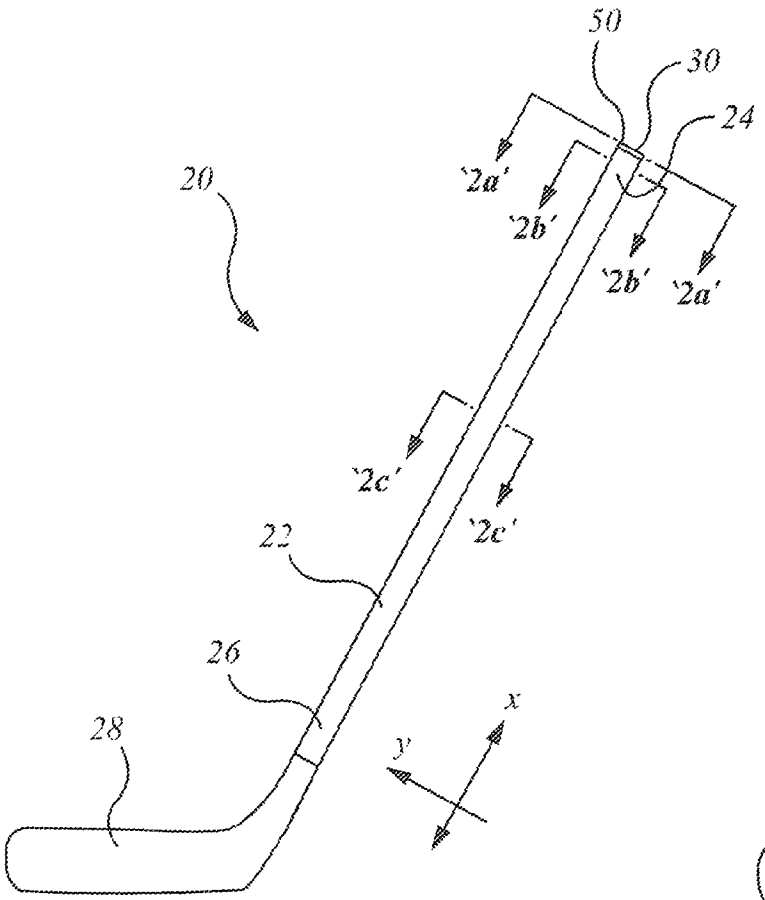
FIG. 1*a* shows a side view of a hockey stick assembly.
Figures 2A, 2B, 2C, 3A, 3B:
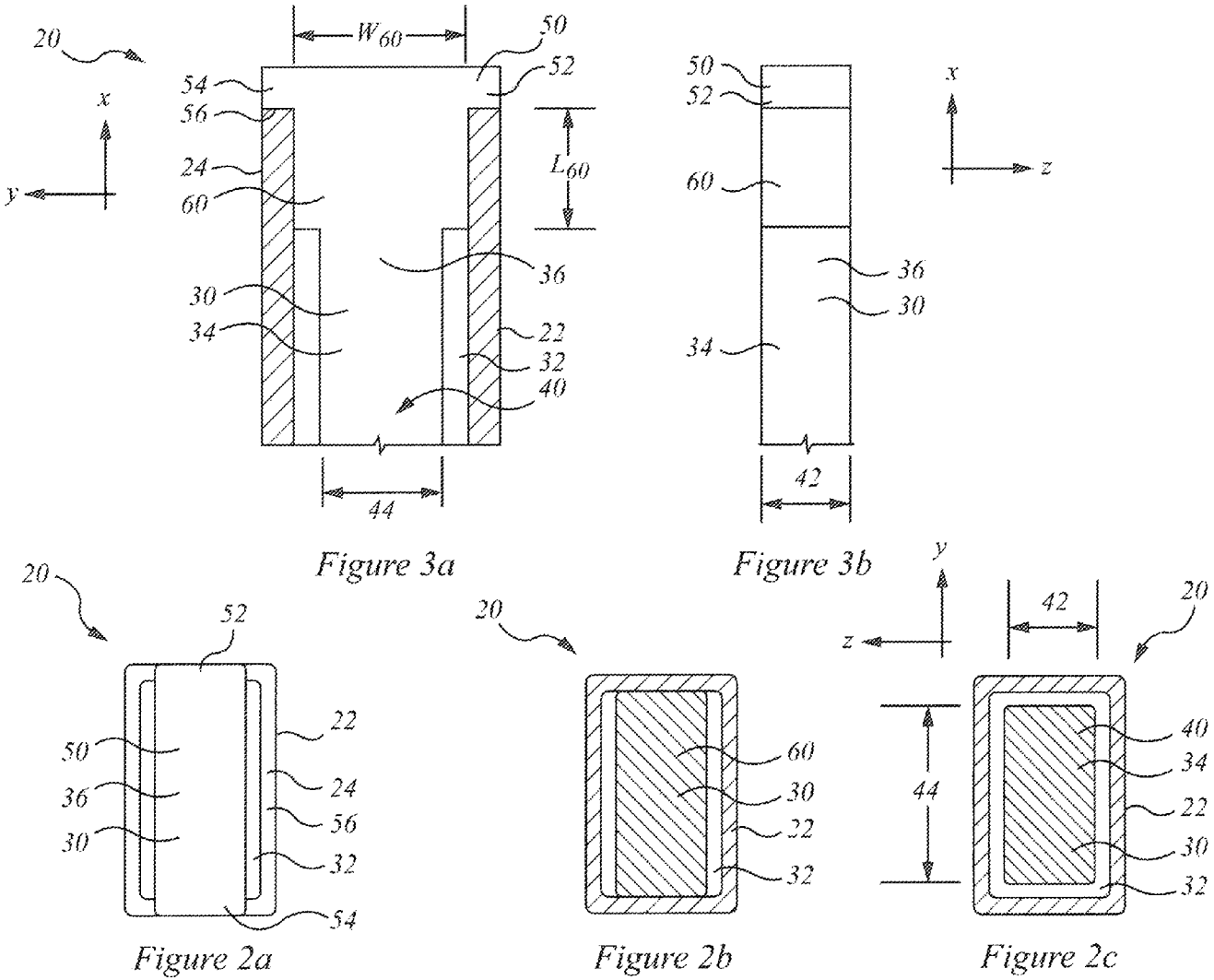
FIG. 2*a* shows an end view of the hockey stick assembly of FIG. 1*a* taken on arrows '2*a*-2*a'*.
FIG. 2*b* shows a cross sectional detail of the hockey stick assembly of FIG. 1*a* taken along section '2*b*-2*b'*.
FIG. 2*c* shows a cross sectional detail of the hockey stick assembly of FIG. 1*a* taken along section '2*c*-2*c'*.
FIG. 3*a* shows an enlarged detail, in side view of the hockey stick assembly of FIG. 2*a* on section '3*a*-3*a'*.
FIG. 3*b* shows an enlarged detail, in side view of an insert of the hockey stick assembly of FIG. 3*a* viewed on arrow '3*b'*.

FIG. 1*a* shows a side view of an example hockey stick assembly 20 according to an embodiment of the invention herein. More generically, hockey stick assembly 20 is an example of a third degree lever apparatus such as may be employed in a sporting activity. Assembly 20 includes a hollow shaft 22 having a first end 24 and a second end 26. First end 24 may be the top or butt end of the stick. A blade 28 may be mounted at said second end 26. An insert 30 may be introduced into a hollow passage, or space or chamber, or accommodation 32 defined within hollow shaft 22.

Blade 28 may be a removable and replaceable blade having a male engagement interface such as may engage the female socket or interface defined by second end 26. When so engaged, the root of blade 28 may tend to occupy, or plug, or block off, the passageway otherwise defined by the hollow accommodation 32 within shaft 22.

Shaft 22 may be a metal shaft, or, more commonly, may be a reinforced composite shaft. Shaft 22 may be made as an extruded or continually cast rectangular tube, cut into lengths, and, as such, may be of substantially constant dimensions throughout its length. Prior to cutting to length to suit a particular player's height, a hockey stick shaft as manufactured is usually just under 4 ft long (i.e., typically 47½"). As a rectangular shaft it has in cross-section a first dimension in the y-direction, and a second dimension in the z-direction. The y-direction dimension is larger than the z-direction dimension. Typically, the outside dimension in the y-direction is about 1⅛", and the dimension in the z-direction is about ¾". For a hollow section stick, the wall thickness of the tube may tend to depend on the material of which the tube is made, and the desired flexural stiffness. For example, aluminum wall thicknesses may range between about $^{30}/_{1000}$" and $^{50}/_{1000}$"; composite wall thicknesses may range between about $^{75}/_{1000}$" to $^{95}/_{1000}$", and titanium wall thicknesses may be between about $^{15}/_{1000}$" and $^{35}/_{1000}$". There is, therefore, not necessarily a single inside dimension for all sticks, although the inside y-dimension may typically be in the range of about 0.95" to 1.1". A table of more precise dimensions for a range of different types of shaft materials is given in Table 2 of U.S. Pat. No. 6,955,619 of Schutz et al., issued Oct. 18, 2005, and that information may be understood to be included in this description, without redundant repetition herein. As indicated therein, it is possible for the wall thickness to be tapered.

Insert 30 may be a member that is, or includes, a strip of material 34 having a length of somewhat less than the internal length of accommodation 32. Insert 30 may have a first end 36 and a second end 38. Second end 38 may be a free end, and may be trimmed to length to correspond to the trimmed-to-length size of hollow shaft 22, and therefore of accommodation 32. That is, it is cut to length to suit the size of the player. Second end 38 can also be trimmed to be shorter than the inside length of accommodation 32, as may be desired.

Insert 30 may have a main or intermediate portion 40 that extends between first end 36 and second end 38. Intermediate portion 40 may be of constant, or substantially constant, cross-section. The cross-section may have a small dimension, being the through thickness dimension 42 in the z-direction; and a width dimension 44, being the dimension in the y-direction. Thickness 42 is less than the inside z-dimension of hollow shaft 22, such that there is a clearance. Similarly, width 44 is less than the inside y-dimension of hollow shaft 22 such that there is a clearance. For example, the y-dimension may be in the range of 0.7 to 0.9 inches, and in one embodiment may be about ¾"; the z-direction dimension may be in the range of about ⅜" to about ⅝", and in one embodiment may be about ½". By having a clearance in both the y-direction and z-direction, strip of material 34 can be fed into shaft 22 from the butt end, i.e., first end 36, of hollow shaft 22.

First end 36 may have an indexing fitting 50. Indexing fitting 50 may include a stop, or hook, or dog, or shoulder, or abutments, or flange, or tangs, or tabs, finger or fingers 52, 54, however they may be termed, that extend or protrude outwardly sufficiently far to prevent entry of indexing fitting 50 into accommodation 32. That is, indexing fitting 50 is too large to pass into shaft 22. As such, indexing fitting 50 engages the end face 56 of first end 36. This abutting relationship defines an engagement interface, and locates insert 30 in its seated or installed position relative to hollow shaft 22. The engagement is a one-way engagement, in the sense that it permits insert 30 also to be retracted or removed, should that be desired. It limits translational motion of insert 30 into shaft 22. Once installed, a butt end cap may be place on the end of the stick, or the end of the stick may be taped with hockey tape to form an enlarged butt. Fingers 52, 54 protrude outwardly beyond the maximum inside dimension of hollow shaft 22 in at least one of the y and z directions. In the embodiment shown, fingers 52, 54 protrude in the y-direction. Fingers 52, 54 may sit flush with, or shy of, the outside face of shaft 22. If desired, they may be trimmed to meet this condition. Where a prefabricated butt-end cap is used, fingers 52, 54 fit within commonly available butt-end caps so that such cap may slide onto first end 36 of hollow shaft 22 in the normal manner. Alternatively, when the end of the stick is taped, fingers 52, 54 are captured in place. One finger 52 or 54 would be sufficient to restrict the axial movement of insert 30, and to locate insert 30 relative to shaft 22. However, it may be convenient for two such tabs or fingers 52 and 54 to be used, and for those tabs to be symmetrical.

First end 36 may also have a widened portion 60 inboard of, and adjacent to, fingers 52, 54. Widened portion 60 may be widened in either the y-direction or the z-direction, or both. Widened portion 60 may extend only a relatively short distance into accommodation 32. The length of widened portion 60, identified as $L_{60}$, may be of the same order of magnitude as width 44, or a small multiple of that width. For example, the width of widened portion 60 in the y-direction, $W_{60}$, may be approximately the same as its length, $L_{60}$. It could be as much as twice or three times as long. In any case, it may be of the order of an inch or two long, and the width may match the inside dimension of hollow shaft 22. The width of widened portion 60 may prevent finger 52 (or finger 54, as may be) from entering accommodation 32. That is, the difference between $W_{60}$ and the inside dimension of shaft 22 is less than the protrusion distance, or overhang distance, of finger 52 or 54. In some embodiments widened portion 60 may be slightly oversize such that the fit is an interference fit such as may tend to discourage movement, or it may be fit having a tolerance of less than the wall thickness of shaft 22. Widened portion 60 need not be immediately adjacent to fingers 52, 54, but could be spaced from first end some distance. It may also be that there is more than one widened portion. It may be convenient however, for there to be a single widened portion 60, and for it to be longitudinally immediately adjacent to fingers 52 and 54, such that fingers 52, 54 may be seen as, or may be considered to be, extensions spreading outwardly from portion 60.

The cross-section of intermediate portion 40 may be relatively large. It may tend substantially to fill the corresponding cross-section of hollow shaft 22. That is, it may have a cross-sectional area that is more than ⅖ of the cross-sectional area of hollow shaft 22. In some embodiments, it may be more than ¾ as wide, or ¾ as thick, as the hollow passage of shaft 22, or both. In one embodiment it may occupy about half the cross-sectional area.

Material 34 may be chosen for its weight per lineal measure. For example, if a weight of 2 lbs is to be added to stick assembly 20, material 34 may have a weight of roughly half a pound per lineal foot.

Material 34 may be a damped material. That is, material 34 may be referred to as being "rubbery" whether it contains rubber or not. It may be an elastic or polymeric or rubber material that may tend to flex relatively easily (as compared to a metal, for example, or as compared to the flexural modulus of shaft 22). Thus, while adding distributed weight to the assembly, insert 30 may tend not significantly to alter the flexural properties of stick 20, particularly given the loose fit. That is, insert 30 is not intended to be glued or epoxied or otherwise bonded along its length within shaft 22, but, other than at first end 36, is intended to be free to move or flex. By being a damped material, such as a polymer, such as a rubber, a rubber compound, or a polymer having properties similar to rubber, or an high molecular weight polymer, insert 30 may tend not to rattle inside shaft 22, and when stick assembly 20 is used to contact a puck, insert 30 may tend not to transmit shock to the user's hands. This may be seen in contrast to a metal or other assembly of weights secured by fasteners to a common rigid strip. By having a large cross-section, the space for lateral movement within shaft 22 may tend also to be relatively small, again limiting the scope for insert 30 to rattle inside the shaft. As such the range of travel for rattling may be relatively small in any event. Force transmitted to the user's hands may be carried by shaft 22 in the same manner as if insert 30 were not present. A suitable material may be a high density rubber such as found in floor mats, truck tires, and so on. Other damped materials may also be used. Polymeric materials other than rubber may be used.

It may be that strip of material 34 may be molded. It may be molded as a single monolithic part. Alternatively, rather than being molded, the strip of material 34 may be cut from a sheet of rubber or other polymeric material. The material may be cut from a sheet of constant thickness, with the features of indexing member 50 and of widened portion 60 being formed by cutting the profile to shape. In other embodiments, the width of insert 30 could be varied along its length, or holes or cut-out, or slots could be formed in insert 30 to achieve the effect of altering weight distribution. It is convenient and simple for main portion 40 of insert 30 to be of uniform thickness, width, and lineal weight distribution.

Cutting a single monolithic part may avoid the complexity of fastening several parts and weights together. It may tend to provide a member that is soft, that has no sharp edges, and that is readily installed in the cavity or accommodation in shaft 22. Other than trimming to length, no assembly is required other than insertion into shaft 22.

Figure 5:
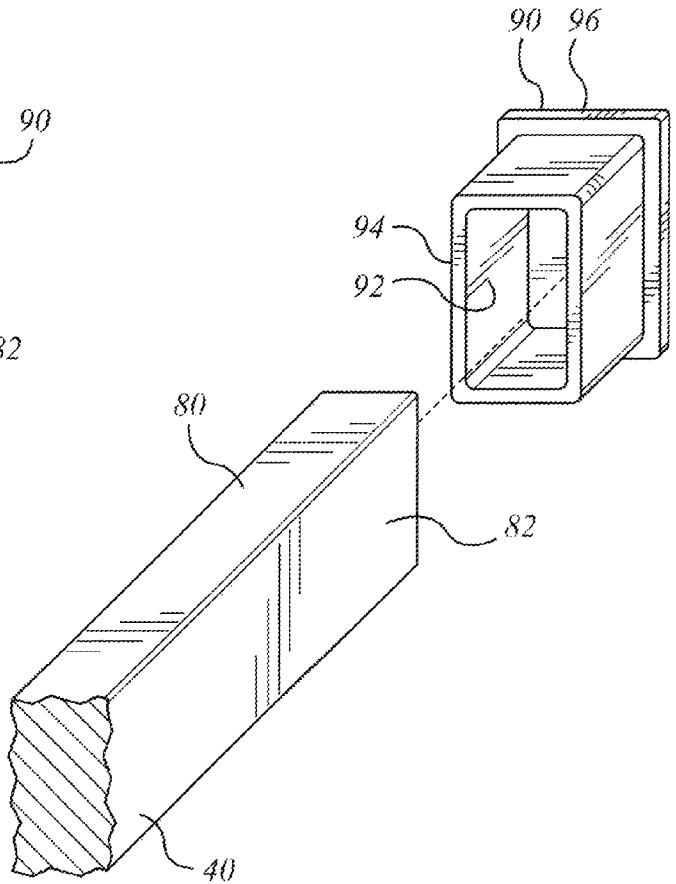
FIG. 5 is a perspective view of a portion of the hockey stick assembly of FIG. 4.
Figure 4:
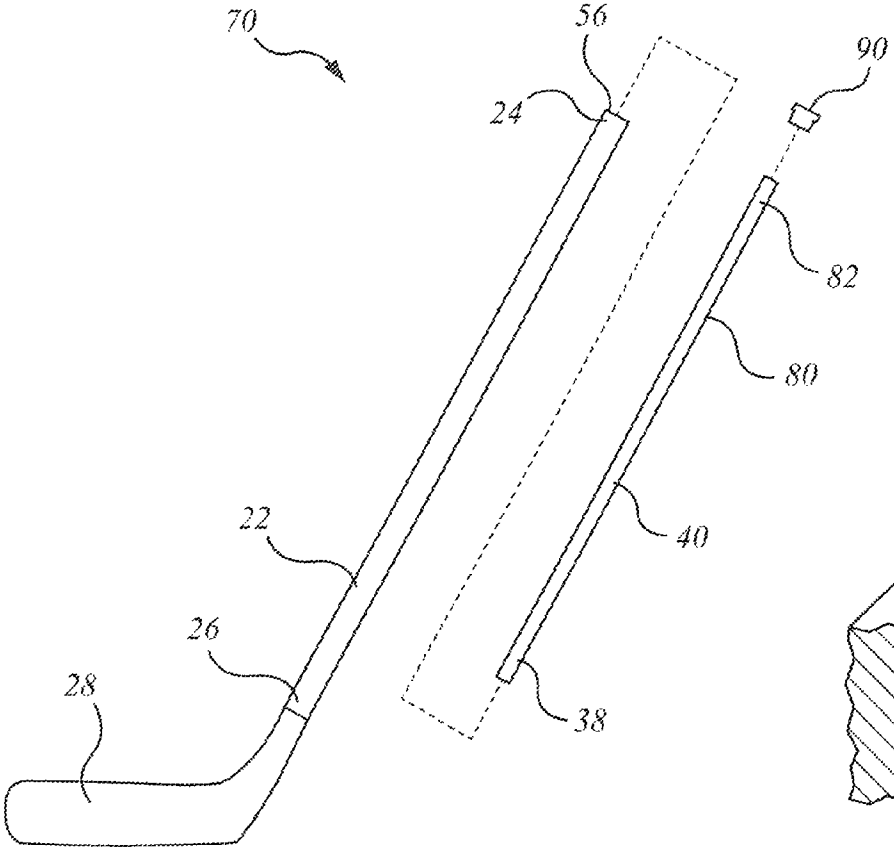
FIG. 4 is an exploded view of another example hockey stick assembly.

Another embodiment of hockey stick assembly 70 is shown in FIGS. 4 and 5. In this embodiment, assembly 70 may have hollow shaft 22 and blade 28 as before. It differs in that insert 80 is not a monolithic member having an indexing member integrally formed at the butt end of the stick. Rather, insert 80 is in essence intermediate or main member or portion 40, and in place of indexing member 50, insert 80 is bonded or chemically or thermally joined as by molding, vulcanizing, or other means, to an indexing member 90 in the form of an end cap having the normal external shape and size of a butt end plug, but with first end 82 of insert 80 permanently bonded thereto. To that end, member 90 may include an internal socket 92 into which first end 82 seats (and is bonded), with the outside dimension of socket wall 94 performing the function of widened portion 60, and the peripherally extending flange defined by the internal side of end face member 96 of member 90 performing the function of fingers 52, 54 to limit inward motion of insert 80 into accommodation 32, thereby to locate insert 80 in position.

In general, it may often be desired that hockey sticks be as light, while remaining robust enough to suit their purpose in shooting the puck. Efforts to that end explain the use of exotic materials such as titanium and various carbon fiber composites, as noted in U.S. Pat. No. 6,955,619 of Schutz. It is counter-intuitive to make a stick heavier.

However, it may also be desired, as in training, to practice with a heavier stick. In practicing with a heavier stick, it may be that one may wish the weight to be distributed fairly evenly rather than being concentrated in one location as might be the case in using steel or lead weights. The use of a heavier stick may permit the player to develop greater strength in shooting. Alternatively, learning to stick-handle, or to poke check or sweep check with a heavier stick may tend to require greater development of upper arm, fore arm, wrist, and hand muscles than with a normally weighted stick. When the weights, i.e., insert 30 or insert 130, are then removed from the stick, as in a game rather than in a practice, the player may find the stick easier and faster to use. Similarly, in addition to not having rattling internal fasteners, where the distributed weighting is made of a damped material, the stick may tend to feel "dead" or unresponsive when used in practice. When the weighting is removed, the stick may feel more lively in the player's hands.

It may also be that apparatus such as insert 30 may be provided in a plurality of varying weights, according to varying densities of the rubber or polymer with different weights being colour-coded e.g., yellow, green, red, and blue. A player may start with a light-weight insert and then proceed to heavier grades of insert as hand and arm strength develop.

Alternatively, a player may have a "game" stick (or sticks) and a practice stick. The weighting may be used in the practice stick, whether it is removable or not. The use of hollow sticks permits internal weighting to be used that may exceed the weight of a traditional wooden stick, without changing the physical size envelope of the stick.

As may be understood, a hockey stick is a third degree lever. Hockey sticks are not the only such sports-playing apparatus to which the principles of the presently described apparatus may apply. For example, a lacrosse stick may have a hollow shaft such as may be suitable for receiving a weight distribution insert, and, as with hockey, strength and dexterity with arms and hand skills may benefit from similar training and strengthening. Similarly, tennis, badminton, and squash rackets may also have hollow handles or shafts.

Several embodiments have been described hereinabove. Further embodiments can be made combining the features and aspects of those embodiments in such combinations and permutations as may be appropriate, as may be understood without need for redundant explanation of further description of all of those possible combinations and permutations.

What has been described above has been intended illustrative and non-limiting and it will be understood by persons skilled in the art that other variances and modifications may be made without departing from the scope of the disclosure as defined in the claims appended hereto. Various embodiments of the invention have been described in detail. Since changes in and or additions to the above-described best mode may be made without departing from the nature, spirit or scope of the invention, the invention is not to be limited to those details but only by the appended claims.

I claim:

1. An insert for a hollow hockey stick shaft, said insert comprising:

an elongate member having a first end and a second end;

said first end having an indexing member too large to pass into the hockey stick shaft, said indexing member defining an engagement interface limiting translational motion of said insert into said hollow hockey stick shaft; and said elongate member including a damping material;

said damping material of said elongate member being at least predominantly one of (a) a rubber material; and (b) a visco-elastic polymer;

said elongate member having a length corresponding to at least a predominant portion of the hockey stick shaft;

the elongate member having a cross-sectional area, said cross-sectional area corresponding to at least half of the internal cross-sectional area of the hollow hockey stick shaft.

2. The insert of claim 1 wherein said insert includes an enlarged end portion adjacent to said indexing member, said enlarged portion having a size that is one of:

(a) an interference fit within the hollow hockey stick shaft; and (b) a clearance fit having a tolerance of lateral motion of less than the hollow hockey stick shaft's wall thickness.

3. The insert of claim 1 wherein said insert includes an end socket; and said first end of said elongate member is secured within said socket; and said indexing member protrudes away from said socket substantially cross-wise to said elongate member.

4. The insert of claim 1 wherein:

said elongate member is made from a strip of material of constant thickness;

said material is a rubber-containing material; and said elongate member has a predominant portion extending away from said indexing member, said predominant portion being sized to fit loosely within the hollow hockey stick shaft.

5. The insert of claim 1 wherein the insert is monolithic.

6. A hockey stick having a hollow shaft and a loose-fitting internal strip;

said hollow hockey stick shaft having an internal cross-sectional area;

said internal strip extending substantially from end-to-end of said hollow shaft of said hockey stick;

said internal strip having a cross-section that occupies at least half of said internal cross-sectional area of said hollow shaft of said hockey stick;

said loose-fitting internal strip is an insert;

said insert has a first end and a second end, said insert including, an elongate portion sized to have a loose fit within the hockey stick shaft, and having a length to extend along at least a substantial portion of the hockey stick shaft;

an indexing member located at said first end of said insert, said indexing member being too large to enter the hockey stick shaft;

said elongate portion being made of a material that is one of (a) a rubber material; and (b) a visco-elastic material.

7. The hockey stick of claim 6 wherein:

said internal strip is an elongate member made of a rubber-based material of constant thickness;

said indexing member is one of (a) made monolithically as a portion of said elongate member having at least one protrusion for engaging an end of the hollow hockey stick shaft, and including a widened portion adjacent to said at least one protrusion, said widened portion at least locally inhibiting cross-wise motion of the insert within the hollow hockey stick member; and (b) a member defining a socket into which an end of the elongate member is secured, and including at least one projection for engaging an end of the hollow hockey stick shaft, said socket defining a widened portion of said insert, said widened portion at least locally inhibiting cross-wise motion of the insert within the hollow hockey stick member.

8. A hockey stick assembly comprising the hockey stick of claim 7, and wherein:

said hollow shaft has a first end and a second end;

a blade is secured to the second end of the shaft; and a weight distributing member is disposed within the shaft, the weight distributing member being formed at least in part of the internal strip.

9. The assembly of claim 8, wherein the internal strip is made of a visco-elastic polymer.

10. The assembly of claim 8 wherein the weight distributing member has a substantially even weight distribution therealong.

11. The assembly of claim 8 wherein the member is monolithic.

12. The assembly of claim 8 wherein the weight distributing member has a substantially uniform solid cross section running along at least a predominant portion of its length.

13. The assembly of claim 6 wherein said indexing member extends out from the first end of the shaft, and has laterally opposed flange portions resting on opposed edges of the first end of the shaft to prevent the indexing member from sliding into the shaft.

14. The assembly of claim 12, wherein the indexing member includes a plug portion, the plug portion abutting opposed interior surfaces of the shaft to inhibit lateral movement of the indexing member relative to the shaft.

15. A hockey stick assembly comprising:

a hollow shaft having a first end, a second end, and an interior passage extending therebetween;

a blade secured to the second end of the shaft; and a monolithic weight distributing member;

said weight distributing member having an elongate body dimensioned to slide in a loose fit into the hollow shaft from the butt end of the hockey stick, the elongate body being formed of a vibration damping material;

the weight distributing member including an end fitting for engaging the butt end of the hockey stick;

the weight distributing member extending along a length of the interior passage, said weight distributing member occupying at least half a passage volume of the interior passage taken along the length of the interior passage.

16. The hockey stick assembly of claim 15 wherein:

said monolithic weight distribution member is made of a rubber-based material of constant thickness;

said end fitting is one of (a) made monolithically as a portion of said weight distribution member and has having at least one protrusion for engaging an end of the hollow hockey stick shaft, and including a widened portion adjacent to said at least one protrusion, said widened portion at least locally inhibiting cross-wise motion within the hollow hockey stick member; and (b) a member defining a socket into which an end of the weight distribution member is secured, and including at least one projection for engaging an end of the hollow hockey stick shaft, said socket defining a widened portion, said widened portion at least locally inhibiting cross-wise motion within the hollow hockey stick member.

17. The hockey stick assembly of claim 15 wherein said vibration damping material is at least predominantly one of:

(a) a rubber material;

(b) a visco-elastic polymer.

18. The hockey stick assembly of claim 15 wherein the weight distributing member has a substantially even weight distribution therealong.

19. The hockey stick assembly of claim 15 wherein the member has a substantially uniform solid cross section running along at least a predominant portion of its length.

20. The assembly of claim 15 further comprising an indexing member located at one end of said weight distributing member, said indexing member extending out from the first end of the shaft, and having laterally opposed flange portions resting on opposed edges of that end of the shaft to prevent the indexing member from sliding into the shaft.

* * * * *